US005527148A

United States Patent [19]

Aust et al.

[11] Patent Number: 5,527,148

[45] Date of Patent: Jun. 18, 1996

[54] REGENERATIVE COMPRESSOR WITH ANNULAR COVER PART

[75] Inventors: Norbert Aust; Manfred Balling, both of Bad Neustadt/S, Germany

[73] Assignee: Siemens Aktiengesellschaft, München, Germany

[21] Appl. No.: 117,123

[22] PCT Filed: Mar. 2, 1992

[86] PCT No.: PCT/DE92/00167

§ 371 Date: Sep. 20, 1993

§ 102(e) Date: Sep. 20, 1993

[87] PCT Pub. No.: WO92/16752

PCT Pub. Date: Oct. 1, 1992

[30] Foreign Application Priority Data

Mar. 18, 1991 [DE] Germany ..... 41 08 796.0

[51] Int. Cl.[6] ..... F04D 5/00

[52] U.S. Cl. ..... 415/55.1

[58] Field of Search ..... 415/55.1, 55.5, 415/55.6, 55.7, 170.1, 174.3

[56] References Cited

U.S. PATENT DOCUMENTS 4,306,833 12/1981 Sixsmith et al. ..... 415/55.7 X 4,334,821 6/1982 Sixsmith et al. ..... 415/55.5 X

FOREIGN PATENT DOCUMENTS 1382230 11/1964 France .

7418776 11/1975 Germany .

*Primary Examiner*—Edward K. Look

*Assistant Examiner*—Michael S. Lee

*Attorney, Agent, or Firm*—Kenyon & Kenyon

[57] ABSTRACT

A regenerative compressor has a housing in which an impeller (6) rotates. The impeller has a supporting ring (7) fitted with blades (8) and is connected by a wall section (9) to a hub element (10) which can be placed on a drive shaft (5). The wall section (9) forms one lateral boundary wall of the impeller (6) and its axial thickness is less than the axial width of the impeller (6). The other boundary wall of the impeller is formed by an annular cover part (14) secured to the impeller. The cover part extends along at least a partial region between the supporting ring (7) and the hub element (10) and its rim is applied to a corner recess (17) of the supporting ring (7). The compressor also has rectilinear sealing gaps (13 and 23) which extend linearly along their whole length between the boundary walls of the impeller (6) and the walls (12 and 22) of the housing. To simplify the assembly of the cover part, the cover part (14) extends over the whole region between supporting ring (7) and hub element (10) and is clamped axially against the supporting ring (7) and against the hub element (10).

3 Claims, 1 Drawing Sheet

REGENERATIVE COMPRESSOR WITH ANNULAR COVER PART

BACKGROUND OF THE INVENTION

The present invention relates to a regenerative compressor and more specifically to a compressor having an impeller that can rotate within the housing of the compressor, having a support ring with blades wherein the support ring is connected to a hub element by a wall section and the hub element can be pushed onto a drive shaft.

EP-A-0 001 982 discloses a regenerative compressor of this type. In this regenerative compressor, a cover part is configured as a flat, annular disk. This disk has an assembly opening and is pushed onto an annular step provided on the hub element. At its rim, the disk is in contact in a corner recess configured on the supporting ring. The cover part is held by means of a front washer fastened by a screw connection at the end of the shaft of the impeller.

The front washer is supported on both the axially protruding annular step and on the cover part. The axial protrusion of the annular step must correspond precisely to the thickness of the cover part if the front washer is to come into contact with the cover part at all.

During a revolution of the impeller, different pressures act on the cover part at different locations on the periphery of the impeller so that the cover part may vibrate.

SUMMARY OF THE INVENTION

The present invention provides an arrangement for use in a generic type regenerative compressor That keeps the cover part is held firmly pressed onto the impeller.

In accordance with an embodiment of the present invention, the compressor having the impeller and supporting ring equipped with blades has a wall section that forms a boundary region for the impeller. The axial thickness of this wall section is less than the axial width of the impeller. An annular cover part has a rim in contact with a corner recess of the supporting ring and forms another boundary wall. That cover part includes an assembly opening that permits the element to be pushed onto the impeller. The sealing gaps present between the boundary walls of the impeller and the housing walls extend linearly over their full length. The cover part is held in contact on the supporting ring and the hub element by axial clamping.

Particularly in the corner recesses of the supporting ring, such an axial clamping of the cover part achieves firm pressure on the cover part and therefore prevents the undesirable vibration.

Two embodiments of the regenerative compressor permit clamping of the cover part to be achieved in a simple manner.

In one such embodiment the cover part is flat and is held in the region of its assembly opening by a clamping element against a contact surface of the hub element. The assembly opening may be a shaft opening such that the cover part can be pressed onto the shaft. The plane of the contact surface may be set back axially to the plane of the corner recess of the supporting ring.

In an alternative embodiment the cover part may have a conical shape and may be held by a clamping element against a contact surface on the hub element. The plane of the contact surface is located in the plane of the corner recess provided on the supporting ring.

In each of these embodiments the clamping element is a clamping ring that can be pressed against the cover part by a bolt arranged at the end of the shaft. The bolt which is necessary in any case for fastening the hub element onto the drive shaft can also undertake the application of pressure to the clamping ring. In consequence, no additional component is necessary for applying the clamping force.

BRIEF DESCRIPTION OF THE DRAWINGS

The subject matter of the application is described in more detail below by means of an embodiment example represented in the drawing. In this.

DETAILED DESCRIPTION

Figure 2:
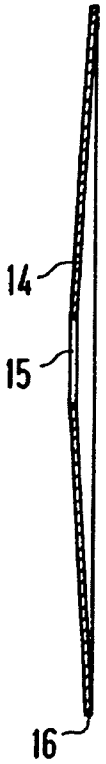
FIG. 2 shows, in section, a cover part configured in conical shape.

A regenerative compressor connected to a drive motor 2 is indicated by 1; its housing consists of first and second housing halves 3 and 4. The regenerative compressor 1 also has an impeller 6. The impeller 6 has a supporting ring 7 on which are arranged the blades 8 of the impeller 6. The supporting ring 7 is connected by means of a wall section 9 to a hub element 10 pushed onto the end of the shaft 5, which is led out of the drive motor 2. The hub element 10 is torsionally connected to the shaft 5.

The wall thickness of the wall section 9 is dimensioned so as to be thinner than the axial width of the impeller 6. Furthermore, the wall section 9 is arranged to one side of the impeller 6 so that it forms a boundary wall of the impeller 6. Due to this lateral arrangement of the wall section 9, there is a niche-shaped recess 11 of the impeller 6.

In order to achieve a good delivery performance from the regenerative compressor, it is important that the pressure losses which occur over the gaps existing between the rotating and stationary parts should be kept as small as possible. This can be achieved by both as narrow a gap as possible and as long a gap as possible.

A relatively long, narrow gap 13 is therefore formed between one boundary wall of the impeller 6 formed by the wall section 9 and the wall 12 of the first housing half 3 extending parallel to the wall section 9.

On the side opposite to the wall section 9, a cover part 14, in sheet metal or plastic, is provided which extends from the supporting ring 7 to the hub element 10. The cover part 14 is configured as a round disk and has a shaft opening 15 so that it can be pushed onto the end of the shaft 5. The rim 16 of the cover part 14 is in contact in a corner recess 17 configured on the supporting ring 7. The cover part 14 pushed onto the end of the shaft is pressed, in the region of its shaft opening 15, against a contact surface 21 of the hub element 10 by means of a bolt 18 which is screwed into the end of the shaft 5 and which acts via an intermediate washer 19 on a clamping ring 25 loosely pushed onto the end of the shaft.

Figure 1:
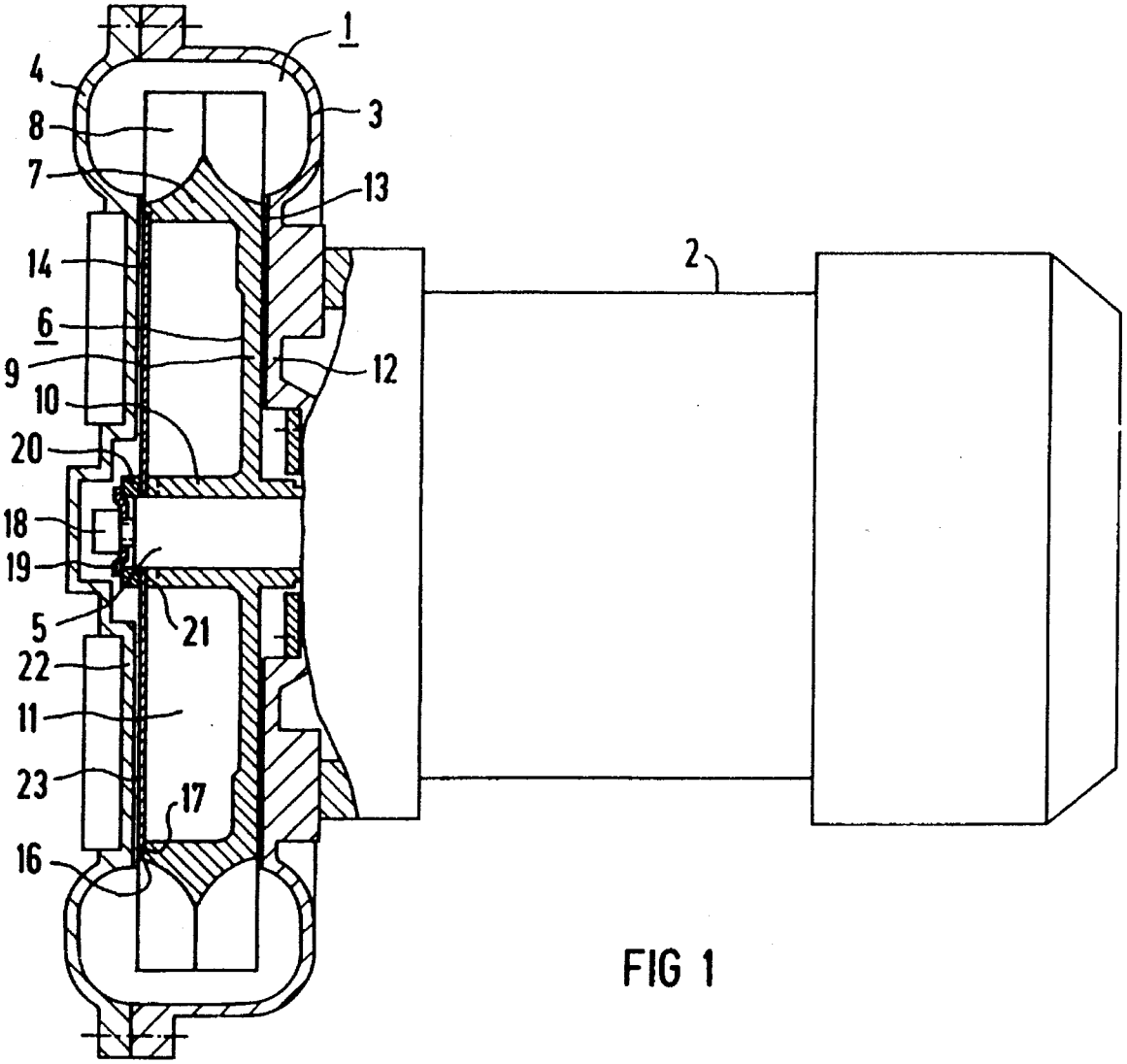
FIG. 1 shows, in section, a regenerative compressor connected to a drive motor.

The axial clamping of the cover part 14 necessary to retain it on the impeller 6 can also be achieved by configuring the cover part 14 in conical shape, as is shown in FIG. 2. Because of this, there is a force acting in the axial direction and pressing the rim 16 of the cover part 14 into the corner recess 17 of the supporting ring 7 when the bolt 18 is tightened. If the cover part 14 is configured so that it is completely flat, it can be pressed axially into the recess 17 by setting the plane of the contact surface 21 configured on the hub element 10 back relative to the plane of the axial contact surface of the corner recess 17 of the supporting ring 7, as is indicated by an interrupted line on the hub element 10 in FIG. 1. In such an embodiment, an axial pressure force is again generated which holds the cover part 14 in contact, in the corner recess 17, with the corresponding contact surface of the corner 1 recess 17 when the bolt 18 is tightened.

The cover part 14 fastened to the impeller 6 forms the other boundary wall of the impeller 6. A long narrow gap 23 is therefore likewise formed between this other boundary wall and the corresponding wall 22 of the second housing half 4, which wall 22 extends almost parallel to the other boundary wall. The gaps 13 and 23, which are therefore present on both sides of the impeller, are characterized by a large sealing effect.

Because the cover part 14 completely covers the niche-shaped recess 11 of the impeller 6, the deposit of dirt in this recess is also prevented.

We claim:

1. An arrangement in a regenerative compressor having a housing, comprising:

an impeller arranged so that it can rotate in the housing of the compressor;

a hub element;

a supporting ring equipped with blades, a wall section connecting said supporting ring to said hub element, said wall section forming one lateral boundary wall of the impeller and being dimensioned so that its axial thickness is smaller than the axial width of the impeller;

another boundary wall, including an annular cover part having a rim in contact in a corner recess of said supporting ring, which extends over the whole region between the supporting ring and the hub element, is pushed onto the impeller by an assembly opening and is fastened to the impeller;

wherein the sealing gaps present between the boundary walls of the impeller and the housing walls extend linearly over their full length, and wherein axial clamping holds the cover part in contact on the supporting ring and the element;

wherein said annular cover part is configured to be flat, and further including a clamping element holding the cover part, in the region of its assembly opening, against a contact surface provided on the hub element, wherein the assembly opening is configured as a shaft opening by which the cover part is pushed onto the shaft and the plane of the contact surface is set back axially relative to the plane of the corner recess provided on the supporting ring.

2. The arrangement of claim 1, wherein a clamping ring is provided as the clamping element, and said clamping ring can be pressed against the cover part by means of a bolt arranged at the end of the drive shaft.

3. An arrangement in a regenerative compressor having a housing, comprising:

an impeller arranged so that it can rotate in the housing of the compressor;

a hub element;

a supporting ring equipped with blades, a wall section connecting said supporting ring to said hub element, said wall section forming one lateral boundary wall of the impeller and being dimensioned so that its axial thickness is smaller than the axial width of the impeller;

another boundary wall, including an annular cover part having a rim in contact in a corner recess of said supporting ring, which extends over the whole region between the supporting ring and the hub element, is pushed onto the impeller by an assembly opening and is fastened to the impeller;

wherein the sealing gaps present between the boundary walls of the impeller and the housing walls extend linearly over their full length, and wherein axial clamping holds the cover part in contact on the supporting ring and the hub element;

wherein the hub element has a contact surface and a clamping element pushing said cover part onto the shaft, holding it against the contact surface provided on the hub element, wherein the plane of which contact surface is located in the plane of the corner recess provided on the supporting ring and the cover part, provided with a shaft opening, is configured in conical shape.

* * * * *